US006509680B2

(12) United States Patent
Aarnink

(10) Patent No.: US 6,509,680 B2
(45) Date of Patent: Jan. 21, 2003

(54) ELECTRON GUN DISPLAY DEVICE PROVIDED WITH AN ELECTRON GUN

(75) Inventor: Wilhelmus A. M. Aarnink, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/464,868

(22) Filed: Dec. 16, 1999

(65) Prior Publication Data

US 2002/0063531 A1 May 30, 2002

(30) Foreign Application Priority Data

Dec. 21, 1998 (EP) ..... 98204350

(51) Int. Cl.[7] ..... H01J 29/46; H01J 29/56; H01J 29/58

(52) U.S. Cl. ..... 313/414; 313/409; 313/412; 313/441; 315/15; 315/381; 315/382

(58) Field of Search ..... 313/412, 414, 313/409, 441, 449; 315/15, 381, 382, 382.1

(56) References Cited

U.S. PATENT DOCUMENTS 2,888,606 A * 5/1959 Beam ..... 315/16
4,620,133 A * 10/1986 Morrell et al. ..... 313/414
4,764,138 A * 8/1988 Bakker ..... 445/3
5,287,038 A * 2/1994 Hagar et al. ..... 315/15
5,668,448 A * 9/1997 Montie et al. ..... 315/382.1
5,744,903 A * 4/1998 Van Der Poel et al. ..... 313/414

FOREIGN PATENT DOCUMENTS

JP 59207544 * 11/1984 ..... H01J/29/48
WO WO9312532 6/1993 ..... H01J/29/62
WO WO9606446 2/1996 ..... H01J/29/46

* cited by examiner

*Primary Examiner*—Ashok Patel
*Assistant Examiner*—Sikha Roy

(57) ABSTRACT

The stray emission in an electron gun comprising a main lens system with one or more intermediate electrodes (42, 43, 44) between the focus electrode (41) and the anode electrode (45) is reduced if at least one of the apertures of the main lens system following the focus electrode has apertures which are smaller than those of the focus electrode. The optimal stray emission situation can be found by designing all the apertures of the main lens system. In order to manufacture an electron gun according to the invention, it is advantageous to have an outside reference system for gun mounting, because it will no longer be possible to center the electrodes on pins through the apertures.

20 Claims, 4 Drawing Sheets

ELECTRON GUN DISPLAY DEVICE PROVIDED WITH AN ELECTRON GUN

BACKGROUND OF THE INVENTION

This invention relates to an electron gun comprising a section for generating at least one electron beam and a main lens system which, viewed in the propagation direction of the electron beam, has a first electrode, a final electrode and at least one intermediate electrode, each having at least one aperture allowing the electron beam to pass and being separated from each other by a gap with a chosen field strength, at least one of the gaps having the highest field strength, a main lens voltage being applied step-wise across said electrodes during operation so as to form an electron-optical focusing lens.

The invention also relates to a display device provided with an electron gun of the type referred to above.

An electron gun as described above is disclosed in European Patent Specification EP-B-0725972. The electron gun according to this specification comprises a main lens with at least one intermediate electrode between the first electrode and the final electrode, as viewed in the propagation direction of the electron beam. In more conventional electron guns, the main lens only has a first and a final electrode, which are usually referred to as the focus electrode and anode electrode, respectively. By adding intermediate electrodes, the main lens is distributed across a larger number of electrodes. For this reason, a main lens of this type is often referred to as a Distributed Main Lens (DML).

The separate electrodes of the main lens system in the known device are interconnected by means of a resistive voltage divider so that the main lens voltage is distributed step-wise across the electrodes during operation in order to reduce the magnitude of potential jumps in the main lens system. This leads to considerably improved lens properties as compared with more conventional guns in which the main lens voltage is entirely applied across only two electrodes. Notably, spherical aberrations can be adequately suppressed to relatively large electron beam currents without an increase of the mechanical lens diameter.

An electron gun of this type can be applied in, for instance, a conventional display device like a cathode ray tube (CRT). Such a display device comprises an evacuated envelope having a neck, a cone and a display window. The electron gun is situated in the neck part of the display device. The display screen is usually provided with electroluminescent material which is excited by the at least one electron beam from the electron gun. Examples are a monochromatic CRT, in which only one electron beam is present and also only one color of electroluminescent material, and the well-known color CRT which has an electron gun for generating three electron beams which, after having passed a color selection means, will excite three colors (e.g. red, green and blue) of electroluminescent material. Furthermore, a deflection unit for generating deflection fields for deflecting the at least one electron beam in the horizontal and in the vertical direction, thus scanning the entire display screen, is mounted around the cone part of the tube.

One of the performance items of an electron gun is its stray emission behaviour. In an electron gun, the different electrodes are separated by a gap. During operation, a voltage is applied to each electrode. As a result, a voltage difference is present across the gap between two adjacent electrodes, which leads to a chosen field strength between the adjacent electrodes. This field strength may give rise to the phenomenon which is referred to as stray emission. This may occur when the electrodes are not absolutely clean, as is the case with 'loose' particles that may get stuck to the electrodes, or when a small burr is left on the electrode. These particles or burrs on the electrodes may serve as a source for electron emission. At the edges of the apertures in the electrodes, the field strength is commonly higher, so that these edges may also serve as a source for electron emission. Electrons originating from such a source are emitted through a large spatial angle and are directed towards the electrode with the higher voltage. For this reason, they are referred to as stray electrons. Especially, stray electrons originating from the main lens may land on the entire screen where they unintentionally excite the electroluminescent material on the screen, causing a deterioration of the contrast performance of the display device.

SUMMARY OF THE INVENTION

It is an object of the invention to provide an electron gun which is constructed in such a way that it shows an improvement with respect to its stray emission behaviour, in comparison with existing electron guns with intermediate main lens electrodes.

According to the invention, an electron gun with which this object is realized is characterized in that, for each electron beam, the aperture of at least one of the electrodes following the first electrode is smaller than the aperture of said first electrode.

Most conventional electron guns are manufactured by using an inner reference system. This means that the several electrodes of the gun, separated by spacers, are mounted on pins. In this process, the anode electrode of the main lens is put on the pins as the first one, and the first electrode, being the one closest to the cathode, is mounted as the last one. During the beading process, two or more beading rods are used for assembling the beaded unit of the gun. In order to be able to remove this beaded unit from the mounting pins, it is necessary that the apertures of the consecutive electrodes show a non-increasing aperture size from the anode electrode to the first electrode. For this reason it is clear that, for more complex electron guns, the inner reference system has serious shortcomings. European Patent Specification EP-B-0376372 discloses a reference system which overcomes these shortcomings. By making use of the specially shaped outer contour of the electrodes, it is possible to use this for aligning the electrodes. For obvious reasons, this is referred to as the outside reference system. The use of such a reference system will be very beneficial for this invention, because it will be possible that one of the electrodes has smaller apertures than its preceding electrode; preceding here means closer to the cathode.

The invention is based on the recognition that, in an electron gun manufactured with the outside reference system, it is possible to make the apertures in at least one of the main lens electrodes smaller than those of at least one of the electrodes closer to the focus electrode (the first electrode). Decreasing the aperture size of an electrode causes more stray electrons to be intercepted by this electrode and, due to this, the stray emission behavior is improved.

A preferred embodiment of the electron gun according to the present invention is characterized in that, for each electron beam, the apertures of the electrodes following the gap with the highest field strength are smaller than the apertures preceding the gap with the highest field strength.

Since the possible occurrence of stray emission is dependent on the field strength, the risk of stray emission is greatest between the electrodes with the highest field strength. Making the apertures of the main lens electrodes following this gap smaller will yield a better stray emission performance.

Another embodiment of the electron gun according to the present invention is characterized in that, for each electron beam, the apertures of consecutive electrodes decrease from the first electrode to the final electrode. In a focusing lens, the electron beam is normally already converging in the region where the electrodes are positioned. This implies that the electron beam diameter decreases from the first electrode to the final electrode. As a consequence, the apertures may decrease without sacrificing beam clearance, which is half the difference between aperture diameter and beam diameter.

A further embodiment of the electron gun according to the present invention is characterized in that, for each electron beam, the aperture of the final electrode is smaller than the apertures of the preceding electrodes of the main lens system. In such an embodiment, only the final electrode differs, which is an advantage for both electron-optical and mechanical reasons. The advantage with respect to the electron optical performance originates from the fact that the intermediate electrodes may be, for example, identical, leading to a partial cancellation of some main lens errors. Having identical intermediate electrodes is of course advantageous for mechanical reasons, because it will be possible to manufacture these from the same equipment.

The invention also relates to a display device provided with an electron gun according to the invention.

BRIEF DESCRIPTION OF THE DRAWING

These and other aspects of the invention are apparent from and will be elucidated, by way of non-limitative example, with reference to the embodiments described hereinafter.

In the drawings.

It should be noted that the drawings are meant to be schematical and are generally not to scale.

DESCRIPTION OF THE PREFERRED EMBODIMENTS

Figure 1:
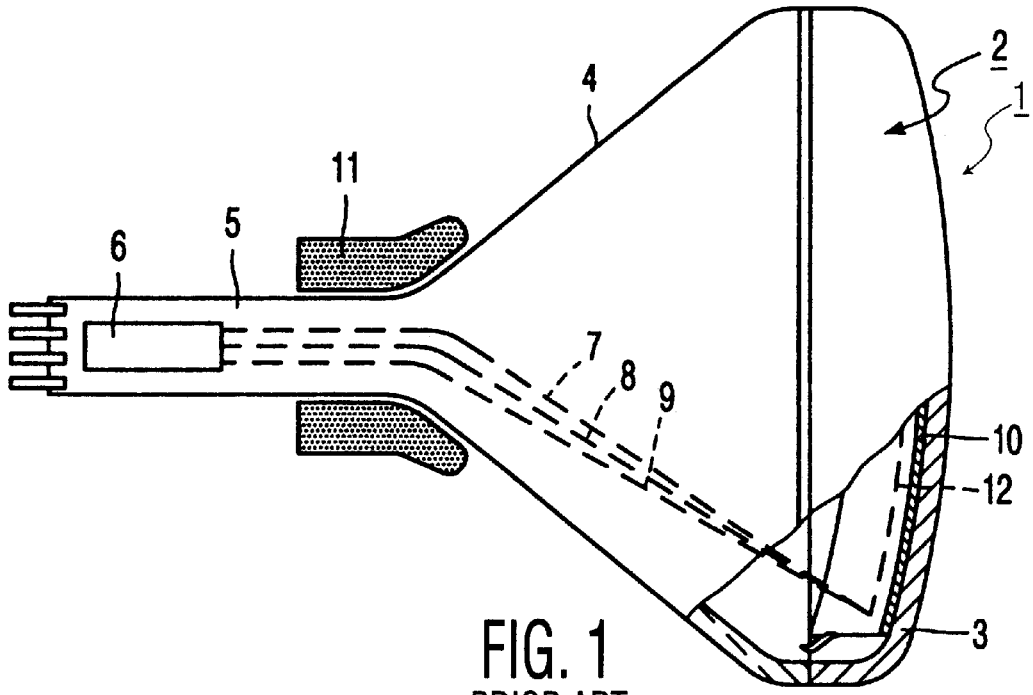
FIG. 1 PRIOR ART
FIG. 1 is a side elevation, partly broken away, of a conventional color display tube with a color selection means.

The cathode ray tube 1 shown in FIG. 1 comprises an evacuated glass envelope 2 with a neck 5, a funnel shaped part 4 and a front panel 3, which may be either curved or flat. A display screen 10 having a pattern of, for example, lines or dots of phosphors luminescing in different colours (e.g. red, green and blue) may be arranged on the inside of the panel 3. A thin mask 12 supported by a frame is positioned at a small distance from the display screen 10. The mask 12 may be an apertured mask having circular or elongate apertures, or a wire mask. During operation of the tube, an electron gun system 6 arranged in the tube neck 5 sends electron beams 7, 8, 9 through the mask 12 to the display screen 10 so that the phosphors will emit light. The electron beams have a small mutual angle causing, at the proper mask-to-screen distance, the electron beams to only impinge on the phosphors of the associated color. A deflection device 11 ensures that the electron beams systematically scan the display screen 10.

In this application, the term electron gun should be considered to have a wide meaning. For instance, it may refer to an electron gun of a colour picture tube as given in FIG. 1 and described above. Another example is a monochromatic tube in which the electron gun only generates one electron beam. The present invention is also applicable to other types of display devices comprising an electron gun which generates one or more electron beams. For this application, the three-color electron gun will be used to illustrate the invention; this should not be considered as limiting the invention.

Figure 2:
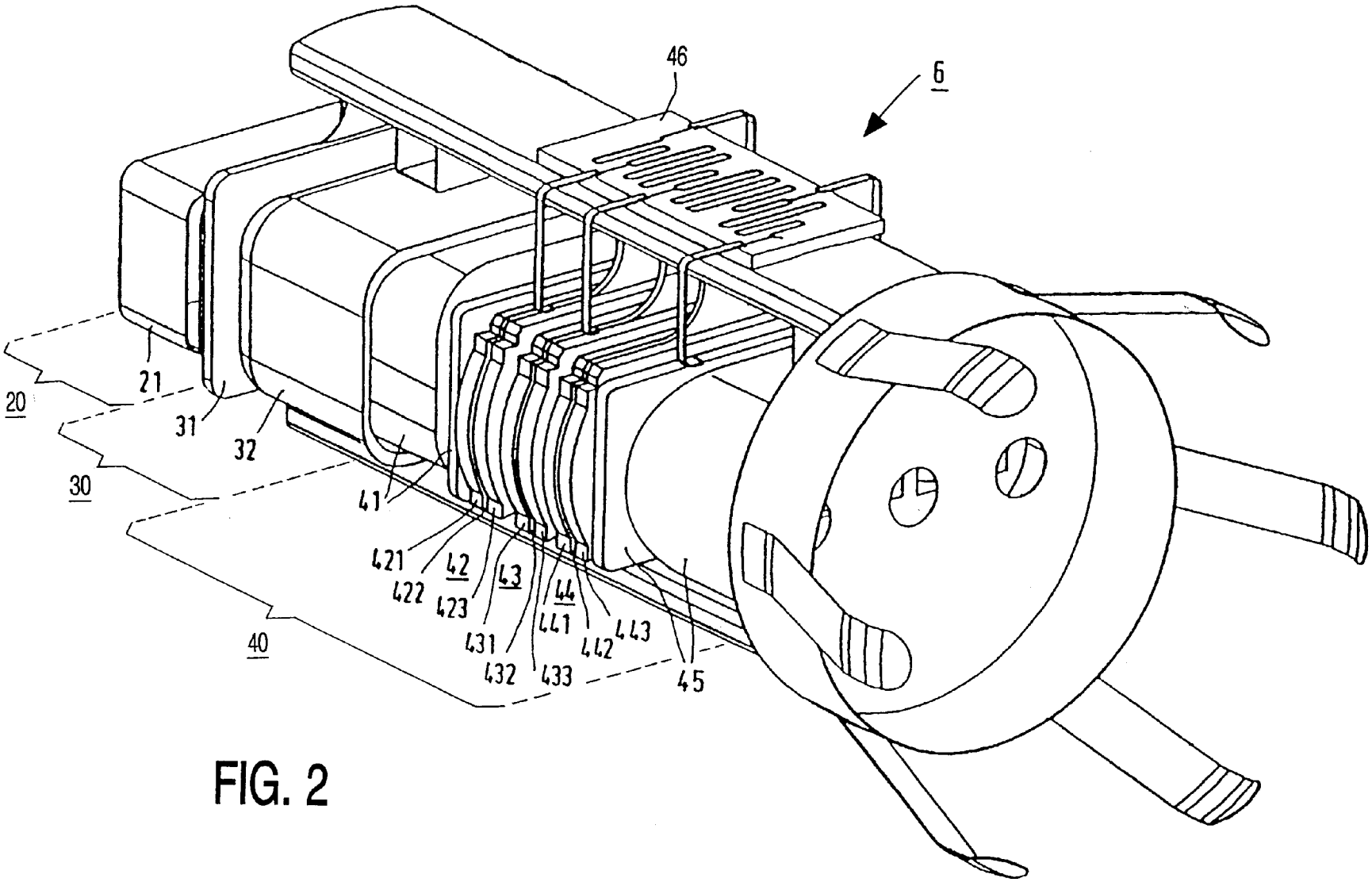
FIG. 2 is a perspective view of an electron gun according to the invention.

The electron gun system 6 is shown in more detail in FIG. 2. This gun comprises a beam-generating section 20, mostly referred to as the triode. This triode consists of three in-line electron sources, e.g. cathodes (not visible in this Figure), a first common electrode 21 and a second common electrode 31. In most current electron guns, the first common electrode 21 is referred to as grid 1 (G1) and is connected to ground; the second common electrode 31 (G2) is mostly connected to a potential in the range of 500–1000 V. The gun also comprises a beam-forming or prefocusing section 30. In this example, the section is constituted by the electrodes 31 and 32, in which electrode 32 is the focus electrode, normally provided with an operating potential between 5 kV and 9 kV. The main lens system 40 of the electron gun 6 is the main focusing section of the gun. The main lens creates a focused image of the virtual object as generated by the triode section. The main lens system 40 of FIG. 2 comprises a first electrode 41, a final electrode 45 and three intermediate electrodes 42, 43, 44. The first and final electrodes are, more commonly, also referred to as focus and anode electrode, respectively. A typical operation voltage range for the anode electrode is 25–35 kV. The main lens voltage is applied step-wise during operation. This can be done by using a resistive voltage divider 46 which is connected to the grids 41–45. The chosen potentials for the intermediate grids 42, 43, 44 are obtained by the proper choice of the taps in the resistive voltage divider 46. In this example, a main lens system is given with three intermediate electrodes; this may, of course, also be a different number. For reasons of convenience three intermediate electrodes are used in the remainder of this application.

Figure 3:
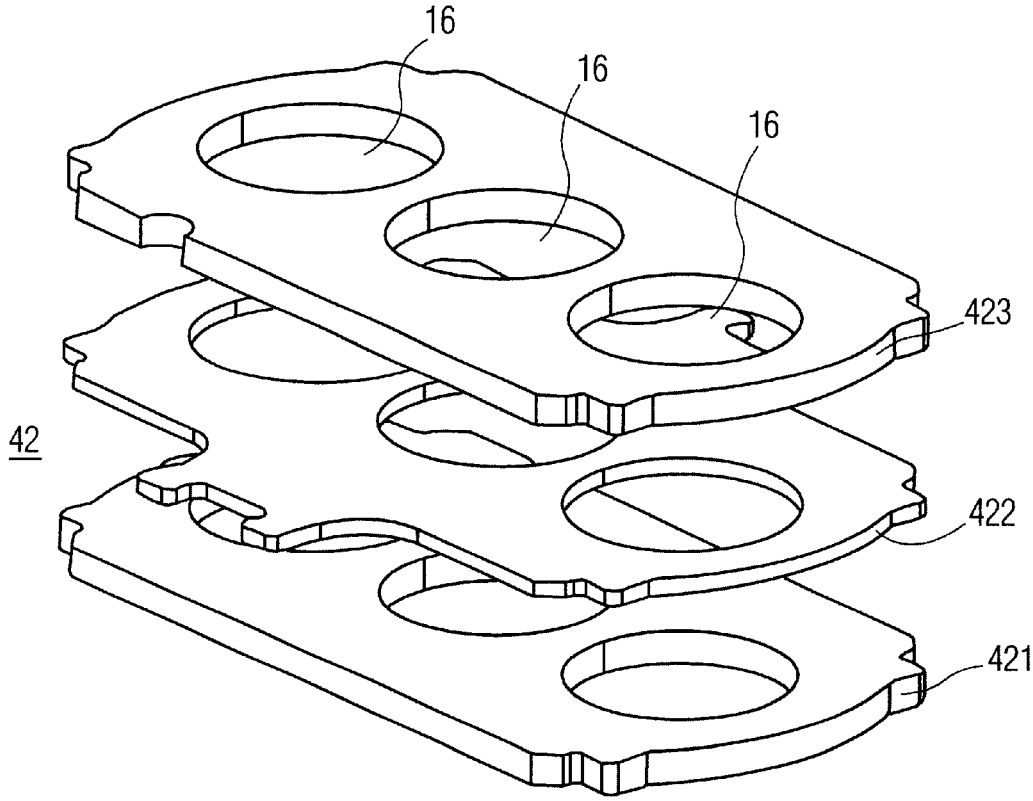
FIG. 3 shows an embodiment of an intermediate electrode of an electron gun according to the invention.

In most practical examples, the intermediate electrodes are made from three plates, as is shown in FIG. 3. For instance, electrode 42 is an assembly of the plates 421, 422 and 423, which may be welded together in order to form one electrode. Some typical dimensions for these intermediate electrodes are: a total thickness of about 2 mm and an aperture size of about 4–6 mm. Of course, it is also possible to assemble an intermediate electrode from a different number of plates.

FIGS. 4*a*–4*d* are cross-sectional side views of different embodiments. Only the main lens section of the electron gun is shown in these Figures.

Figure 4A:
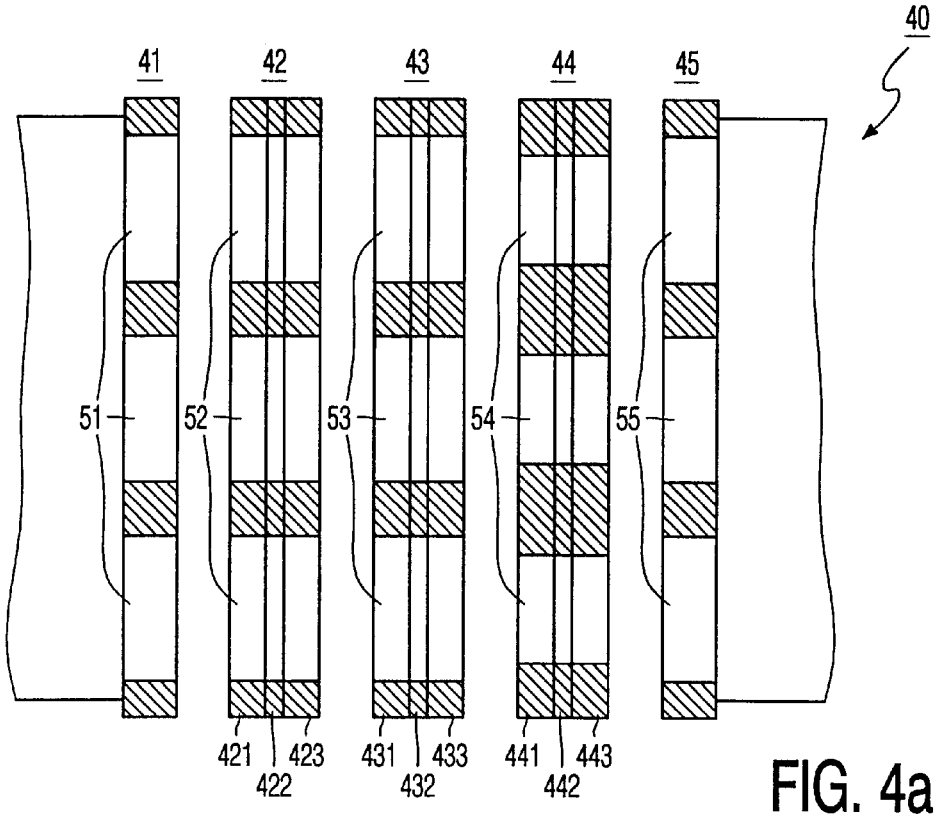
FIGS. 4*a*–4*d* are cross-sectional views of the different embodiments of a main lens system of an electron gun according to the invention.

In FIG. 4*a*, a general configuration is given of an electron gun according to the present invention. In this FIG. 4*a*, the apertures 54 of electrode 44 are smaller than the apertures 51, 52, 53 and 55 of the electrodes 41, 42, 43 and 45. The stray electrons formed between the electrodes 41, 42, 43 and 44 are thus partly intercepted by electrode 44, having the smallest apertures 54, leading to less stray emission on the screen. Of course, stray emission originating from electrode 44 can still pass electrode 45, having larger apertures 55 than the apertures 54 of electrode 44. However, the overall effect on stray emission behaviour is still positive.

Figure 4B:
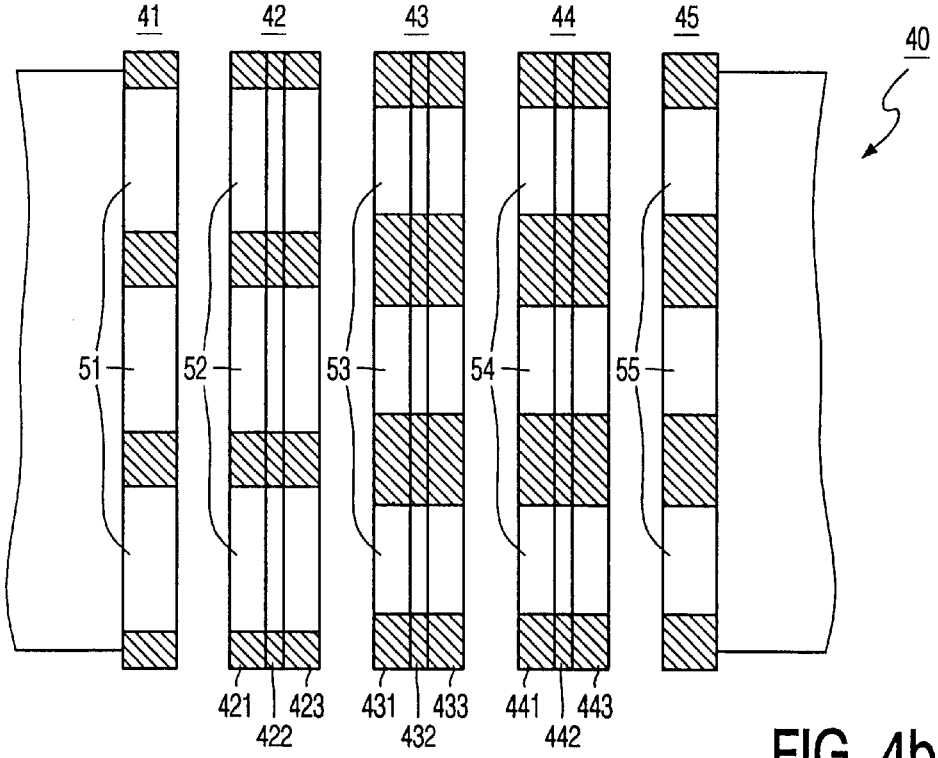

FIG. 4*b* shows a preferred embodiment of the main lens system of an electron gun according to the present invention. This embodiment is preferred because the apertures following the gap with the highest field strength are made smaller. Suppose that the electrical field strength is highest between the electrodes 42 and 43, then the apertures of the electrodes 43 and following electrodes will be made smaller than those of electrodes 42 and preceding electrodes, as viewed in the propagation direction of the electrons. Note that the electrical field strength between two electrodes is given by the voltage difference across the electrodes divided by the gap between the electrodes. In the gap with the highest field strength, stray electrons may be formed more easily so that a reduction of the aperture size for electrodes following this gap is most effective.

Figure 4C:
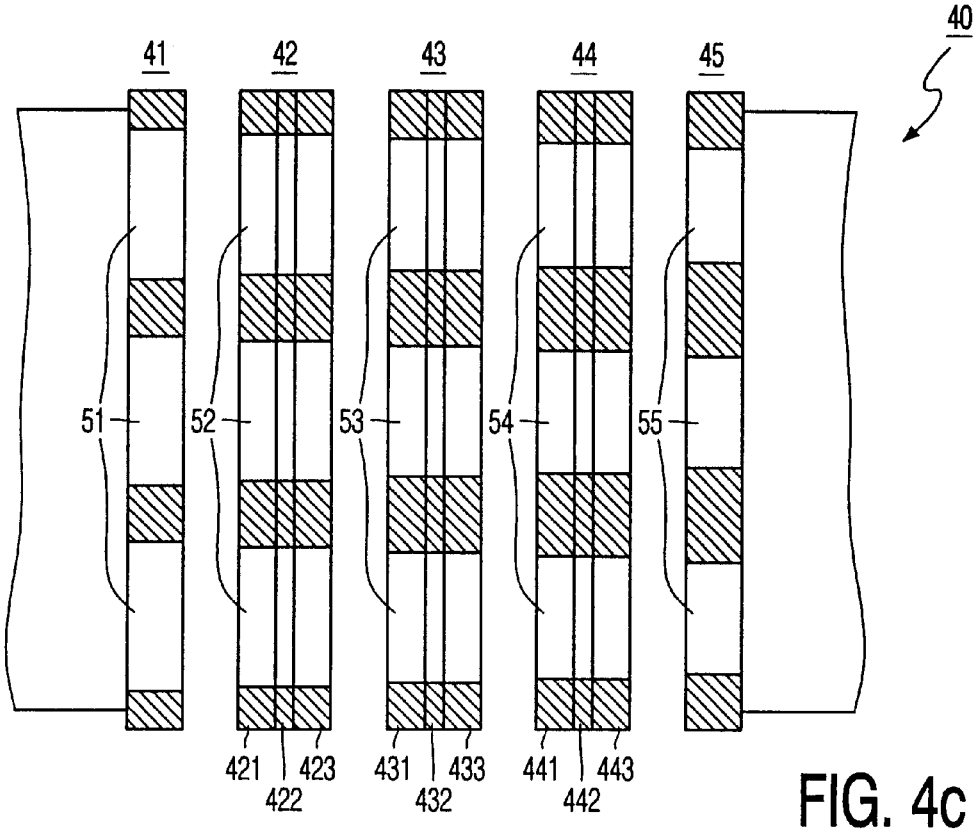

In a further embodiment, the aperture size is reduced in steps over the consecutive electrodes, as is shown in FIG. 4*c*. In this situation, each next electrode slightly reduces the number of stray electrons.

Figure 4D:
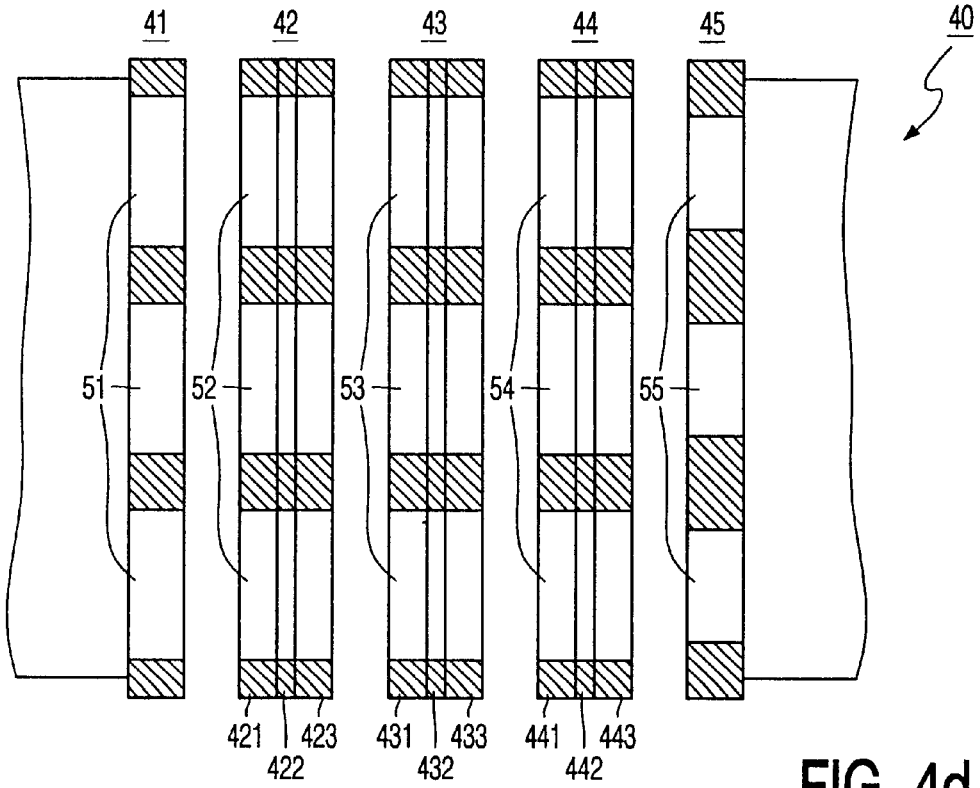

FIG. 4*d* shows an embodiment with a number of electron-optical advantages. In this embodiment, only the apertures of the final, or anode, electrode are reduced. This yields a reduction of the stray emission by roughly the ratio of the aperture size of the electrodes 44 and 45. In an electron-optical design of a main lens system of conventional electron guns, it is often preferred to use a mirrored main lens part. This means that the focus and anode grid are taken from the same batch of gun parts. The advantage is found in the fact that some unpleasant sources of spread in the electron gun, causing a picture with reduced sharpness, are cancelled if mirrored lens parts are used. The sources of spread referred to in the preceding sentence are, for instance, free fall error, beam displacement and core-haze asymmetry. In a DML type electron gun, it is possible to obtain this cancelling effect by using electrodes from the same batch. In the situation where only electrode 45 has smaller apertures and the electrodes 41, 42, 43 and 44 are from the same batch, this cancelling effect is partly realized. The cancellation of electron-optical spread sources is an advantage of this embodiment over the embodiments as shown in FIGS. 4*b* and 4*c*, which were described above.

In summary it is stated that it is possible to reduce the stray emission in an electron gun comprising a main lens system with one or more intermediate electrodes 42, 43, 44 between the focus electrode 41 and the anode electrode 45. If at least one of the apertures of the main lens system following the focus electrode has apertures which are smaller than those of the focus electrode, a reduction of stray emission is realized.The optimal stray emission situation can be found by designing all the apertures of the main lens system. In order to manufacture an electron gun according to the invention, it is advantageous to have an outside reference system for gun mounting, because it will no longer be possible to center the electrodes on pins through the apertures.

What is claimed is:

1. An electron gun comprising: means for generating at least one electron beam, a main lens system which, viewed in the propagation direction of the at least one electron beam, has a first electrode, a final electrode and at least one intermediate electrode, each electrode having at least one aperture allowing the electron beam to pass and being separated from each other by a gap with a chosen field strength, at least one of the gaps having the highest field strength, a main lens voltage being applied step-wise across said electrodes during operation so as to form an electron-optical focusing lens, characterized in that, for each electron beam, the aperture of at least one of the electrodes following the first electrode is smaller than the aperture of said first electrode.

2. An electron gun as claimed in claim 1, characterized in that, for each electron beam, the apertures of the electrodes following the gap with the highest field strength are smaller than the apertures of the electrodes preceding the gap with the highest field strength.

3. An electron gun as claimed in claim 1, characterized in that, for each electron beam, the apertures of consecutive electrodes decrease from the first electrode to the final electrode.

4. An electron gun as claimed in claim 1, characterized in that, for each electron beam, the apertures of the final electrode are smaller than the apertures of the preceding electrodes of the main lens system.

5. An electron gun as claimed in claim 1 wherein said at least one of the electrodes with the smaller aperture is an intermediate electrode whose aperture is smaller than the aperture of a preceding intermediate apertured electrode and smaller than the aperture of the final electrode.

6. An electron gun as claimed in claim 5 wherein the aperture of said preceding apertured electrode is approximately the same size as the aperture of the first electrode.

7. An electron gun as claimed in claim 2 wherein the apertures of the electrodes following the gap with the highest field strength are all approximately the same size.

8. An electron gun as claimed in claim 2 wherein the apertures of consecutive electrodes following the gap with the highest field strength decrease to the final electrode.

9. An electron gun as claimed in claim 4 wherein the apertures of the preceding electrodes of the main lens system are approximately the same size.

10. An electron gun as claimed in claim 1 wherein said electron beam generating means generates three electron beams and each of the electrodes of the main lens system comprises three apertures, one for each electron beam.

11. An electron gun as claimed in claim 10 wherein, for each electron beam, the apertures of the electrodes following the gap with the highest field strength are smaller than the apertures of the electrodes preceding the gap with the highest field strength.

12. An electron gun as claimed in claim 11 wherein the apertures of consecutive electrodes following the gap with the highest field strength decrease to the final electrode.

13. An electron gun as claimed in claim 10 wherein, for each electron beam, the apertures of the final electrode are smaller than the apertures of the preceding electrodes of the main lens system.

14. An electron gun as claimed in claim 10 which comprises three apertured intermediate electrodes.

15. An electron gun as claimed in claim 14 wherein, for each electron beam, the apertures of at least one electrode following the gap with the highest field strength are smaller than the apertures of at least one electrode preceding the gap with the highest field strength.

16. An electron gun as claimed in claim 2 wherein the apertured electrode following the gap with the highest field strength comprises a further intermediate electrode.

17. A display device comprising:

a glass envelope containing at one end a luminescent display screen and at an opposed end an electron gun for generating at least one electron beam and including a main lens system for focusing the at least one electron beam on the display screen, and electron beam deflection means mounted on an external surface of the glass envelope, wherein the main lens system comprises;

viewed in the propagation direction of the at least one electron beam, a first electrode, a final electrode and at least one intermediate electrode, each electrode having at least one aperture allowing the electron beam to pass through and being separated from each other by a gap with a chosen field strength, one gap having the highest field strength, means for applying distributed voltages to said electrodes so as to form an electron-optical focusing lens, and for said at least one electron beam, the at least one aperture of at least one electrode following the first electrode is smaller than the aperture of said first electrode.

18. The display device as claimed in claim 17, wherein for said at least one electron beam, the at least one aperture of at least one electrode following the gap with the highest field strength is smaller than the aperture of at least one electrode preceding the gap with the highest field strength, such that stray emissions in the electron gun are significantly reduced.

19. The display device as claimed in claim 18 wherein at least some of the electrodes of the main lens system have a specially shaped outer contour such as to provide an outside reference system, and wherein the size of the at least one aperture in the at least one electrode is for the most part independent of the gap size between said at least one electrode and the adjacent following electrode of the main lens system.

20. An electron gun as claimed in claim 1 wherein the electrode with the aperture smaller than the first electrode aperture is the at least one intermediate electrode.

* * * * *